US005765738A

United States Patent [19]

Hoffner

[11] Patent Number: 5,765,738

[45] Date of Patent: Jun. 16, 1998

[54] HARNESS FOR SUPPORTING A HANDGUN HOLSTER

[76] Inventor: Brian D. Hoffner, 2516 Sciaaca, Spring, Tex. 77373

[21] Appl. No.: 819,572

[22] Filed: Mar. 14, 1997

[51] Int. Cl.[6] ..... F41C 33/02

[52] U.S. Cl. ..... 224/661; 224/677; 224/911; 224/914; 224/673; 224/901.4

[58] Field of Search ..... 224/661, 911, 224/912, 914, 677, 676, 673, 901.4

[56] References Cited

U.S. PATENT DOCUMENTS

| | | | |
|---|---|---|---|
| 2,869,768 | 1/1959 | Gainsburgh | 224/677 |
| 4,953,767 | 9/1990 | Bennett | 224/661 |
| 5,215,238 | 6/1993 | Baruch | 224/661 |

*Primary Examiner*—Linda J. Sholl
*Attorney, Agent, or Firm*—Marvin J. Marnock

[57] ABSTRACT

A harness for supporting a handgun holster adjacent the thigh of a wearer in a position relative to the wearer's torso which is maintained even though the wearer may be engaged in vigorous activity and precludes shifting of the holster as would disadvantage the wearer in an emergency situation. The harness includes a waist belt and at least one or a pair of substantially rigid shankpieces mounted to the waist belt to extend downwardly alongside the respective thighs of the harness wearer. On the lower end of each shankpiece is fastened a leg strap for tightening about the wearer's leg adjacent thereto and precluding shifting of the waist belt and shankpieces relative to the torso. The handgun holster is mounted on the outside of one of the shankpieces to extend downwardly alongside the thigh in offset relation thereto.

10 Claims, 6 Drawing Sheets

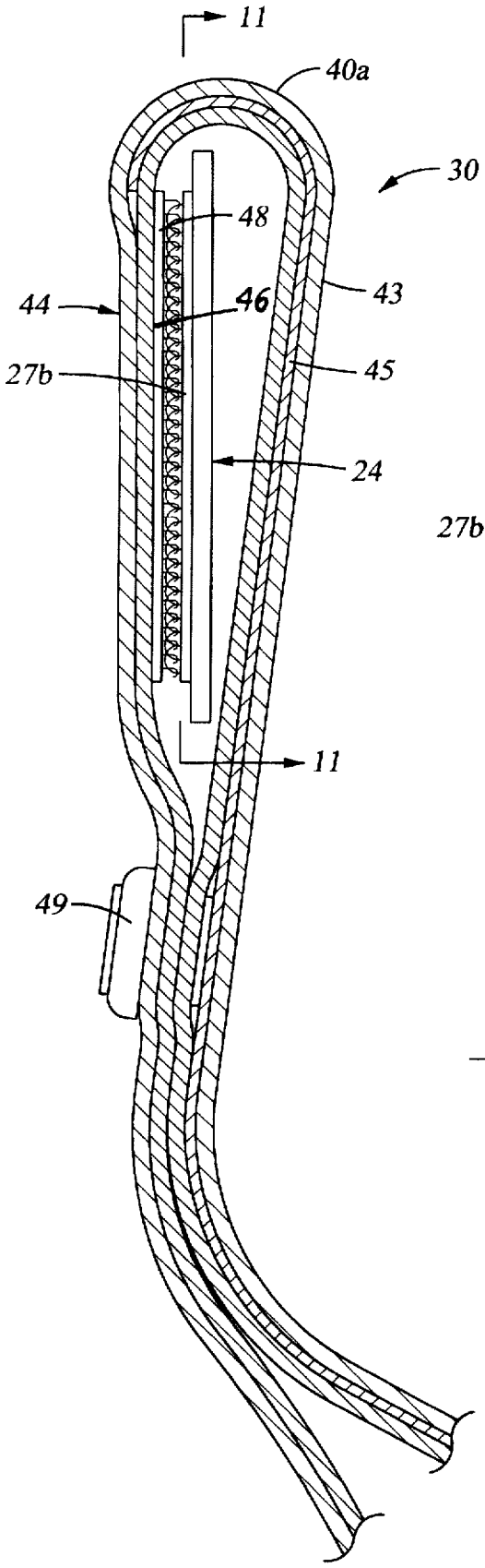
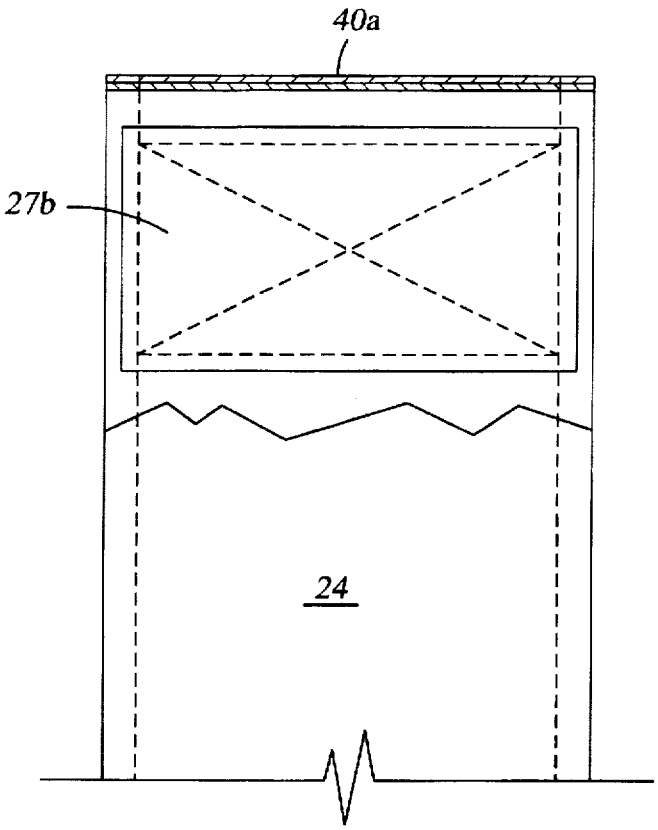
FIG. 11
FIG. 10

HARNESS FOR SUPPORTING A HANDGUN HOLSTER

FIELD OF THE INVENTION

This invention relates to a harness for supporting a handgun holster and more particularly to a harness for supporting a handgun holster and accessory equipment at the thighs of the wearer.

BACKGROUND OF THE INVENTION

In the performance of their duties, members of law enforcement teams, security forces and the like frequently wear holsters for carrying a handgun at the thigh. The thigh is usually the preferred location for a holster if the wearer is also fitted with a flack vest or body armor since their position above the waist may interfere with handgun accessibility. Typically, thigh holsters are suspended from the waist belt and strapped to the leg of the wearer. Accordingly, when the wearer assumes a sitting, kneeling, or squatting position the holster moves with the leg and there is a change in orientation of the gun with respect to the wearer's torso. There is also a danger of the gun falling out of the holster. Furthermore, when the wearer is walking, running or climbing, the swinging movement of the holster not only increases the possibility of the gun falling from the holster, but results in a constantly changing orientation of the holster and gun handle with respect to the wearer's torso such that the gun is less likely to be quickly accessed in an emergency "quick-draw" situation or to be quickly re-holstered. Also, in addition to the swinging motion of the holster as a result of leg movement, the waist belt with the holster and all other items carried on the belt, such as cartridge magazines, tend to shift or turn on the wearer''s body which is contrary to the desired feature that the holster and reloader magazine be maintained in the same relative position with respect to the wearer's torso in order to insure consistently quick and efficient "draws" of the gun and easy one-hand re-holstering by the user, no matter what his body position may be.

SUMMARY OF THE INVENTION

The invention relates to a harness comprising a handgun holster which is adapted to be mounted on a waist belt and supported adjacent the thigh of a wearer in a position relative to the wearer's torso which is maintained even though the wearer may be running or climbing or has assumed or is in the act of assuming a sitting or kneeling position. The harness includes an adjustable waist belt and a shankpiece attached to the waist belt and comprising an outer portion which extends downwardly from the waist belt, a substantially rigid offset section which extends outwardly from the first section and a second vertical section extending downwardly from the outer end of the offset section. A handgun holster is attached to the outside of the second vertical section and oriented such that a handgun mounted therein is pointed downwardly when the wearer stands erect. The shankpiece further includes a curved portion which is folded over the waist belt and an inner second portion which extends downwardly alongside the wearer's thigh between the outer portion of the shankpiece and the thigh. An adjustable strap is fastened to the second rigid portion of the shankpiece and adapted to be strapped about the wearer's thigh at the top end of the thigh at the groin thereby allowing movement of the leg without causing the holster to move relative to the torso. A second shankpiece comprising inner and outer portions like the first shankpiece may also be similarly mounted to the waist belt at the other side of the wearer and a second flexible strap attached to the inner portion of the second shankpiece may be strapped about the other leg of the wearer to further preclude shifting of the waist belt on the wearer's torso. The harness thereby serves to maintain the position of the holster relative to the wearer's torso despite a change in body position and despite any leg motion activities of the wearer, thereby minimizing the likelihood of the gun falling from the holster, and also precluding repositioning or shifting of the holster and handgun to a position as would disadvantage the wearer in a "quick draw" or re-holster emergency situation.

BRIEF DESCRIPTION OF THE DRAWINGS

FIG. 10 is an enlarged fragmentary edge view in vertical cross section of a shankpiece which is adjustably positionable and attachable on the waist belt of the harness of the invention and to which the handgun holster is mounted; and FIG. 11 is a fragmentary view showing the shankpiece of FIG. 10 as viewed from the side of the wearer in FIG. 1.

DETAILED DESCRIPTION OF THE INVENTION

Figure 1:
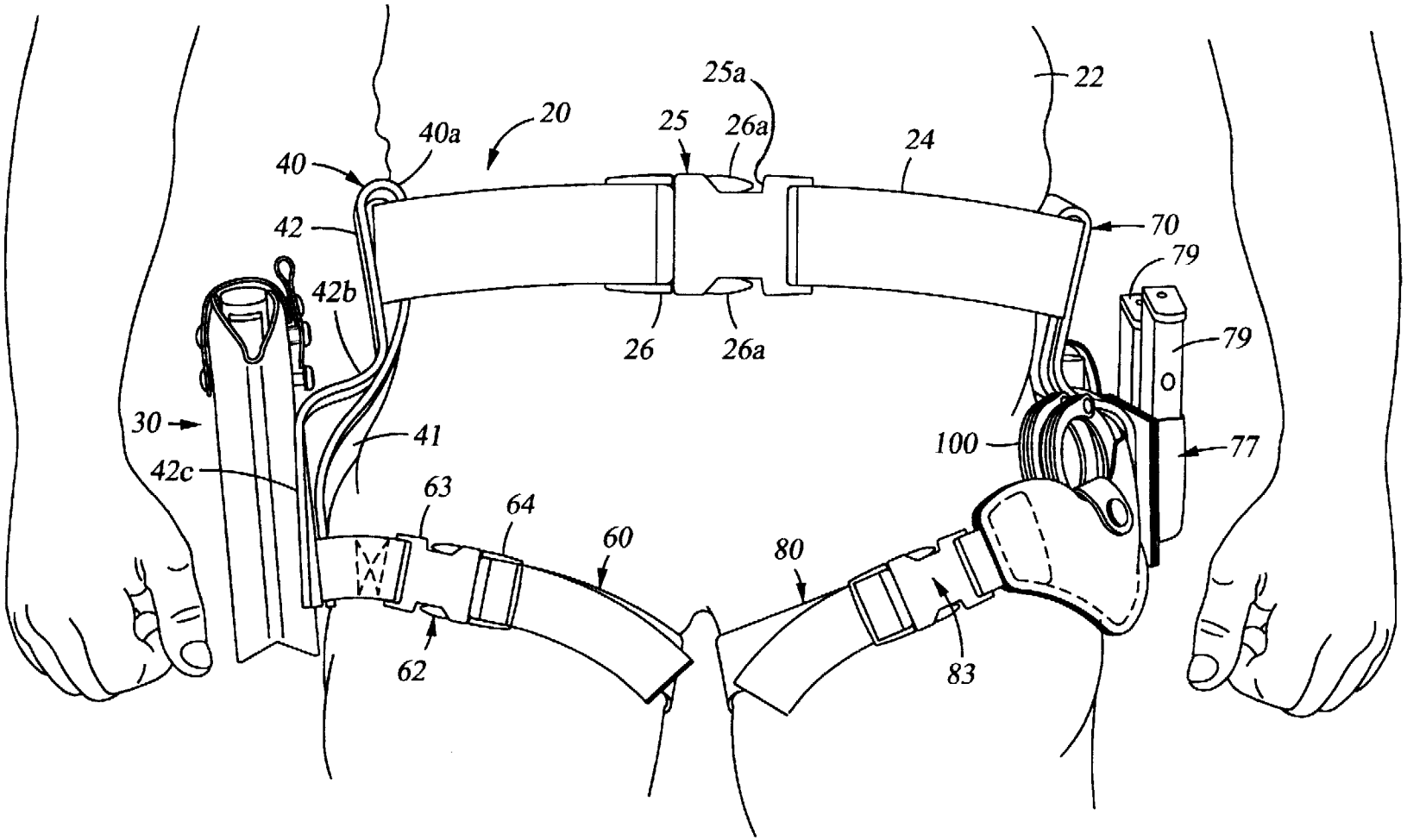
FIG. 1 is a frontal view of the harness of the invention showing the harness as it is normally worn on a person's body.

Referring more particularly to the drawings, there is shown in FIG. 1 a harness 20 which is worn on a person's body 22 for supporting a handgun holster 30. The harness 20 comprises a waist belt 24 which is provided with a conventional buckle 25 of the type which permits adjustment of the belt length so as to allow it to be fitted appropriately about the waist of the wearer's body.

Figure 3:
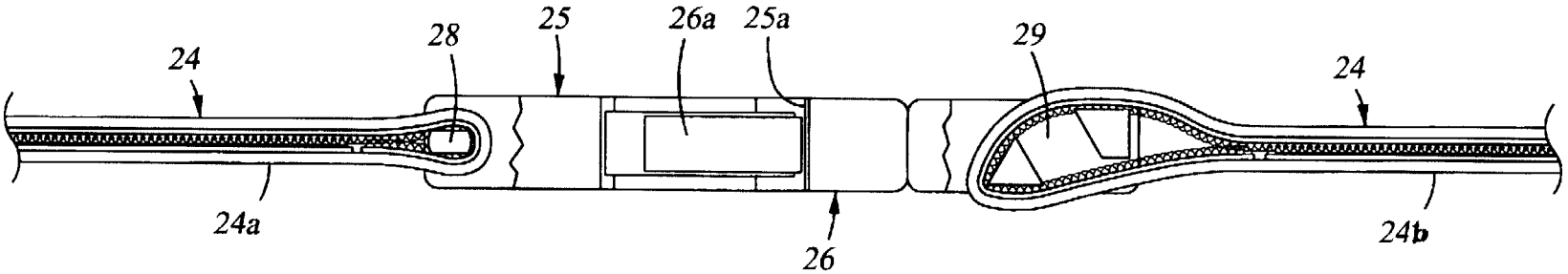
FIG. 3 is an enlarged fragmentary edge view of the waist belt buckle showing its manner of attachment to the waist belt of the harness of FIG. 1.

In FIGS. 1 and 3, the buckle 25 is shown in its belt-fastening condition wherein a buckle latch member 26 has been inserted in the buckle housing. The latch member 26 is provided with a pair of resilient latch members **26*a* which are flexible inwardly towards one another to allow their insertion into the buckle housing and when inserted a predetermined amount, then automatically flex outwardly to lockingly engage shoulders 25*a* of the buckle housing as shown in FIGS. 1 and 3**.

Figure 4:
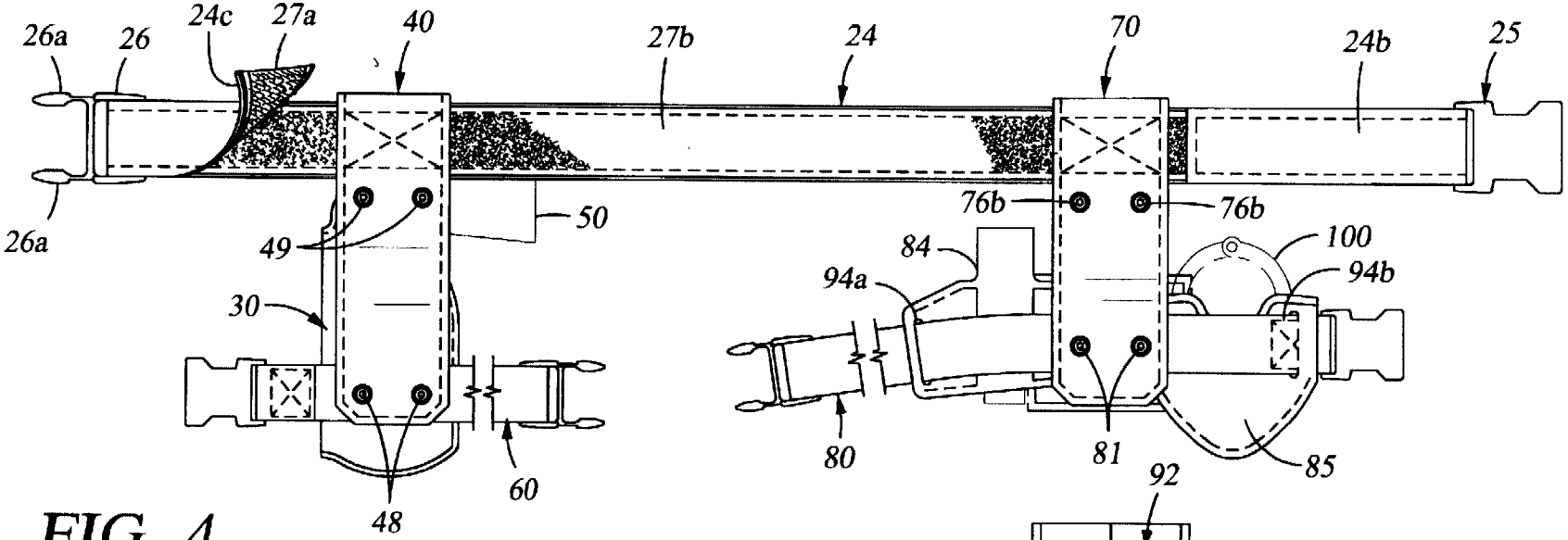
FIG. 4 is a plan view similar to FIG. 2 but showing the inverse side of the harness.

The inner side of each end portion 24*a* and 24*b* of the waist belt 24 is lined with flexible fabric fastener material, such as is sold under the trademark VELCRO. The lining comprises hook fasteners 27*a* and the remainder of the waist belt is lined with loop fastener material 27*b* which is adapted to fasten to the hook material 27*a*. Accordingly, as shown in FIGS. 3 and 4, the end portion 24*a* of the waist belt 24 is inserted through an opening in the buckle housing, folded about a post 28 provided in the buckle housing and fastened to itself by cooperative engagement of its VELCRO loop fastener material with the VELCRO hook fastener lining. In similar manner the other end portion 24*b* of the waist belt 24 is folded about a post 29 which is provided in the latch member 26. The belt end portion 24*b* is then fastened to itself by cooperative engagement of its VELCRO hook fastener material with the VELCRO loop fasteners which line the greater portion of the waist belt.

Figure 7:
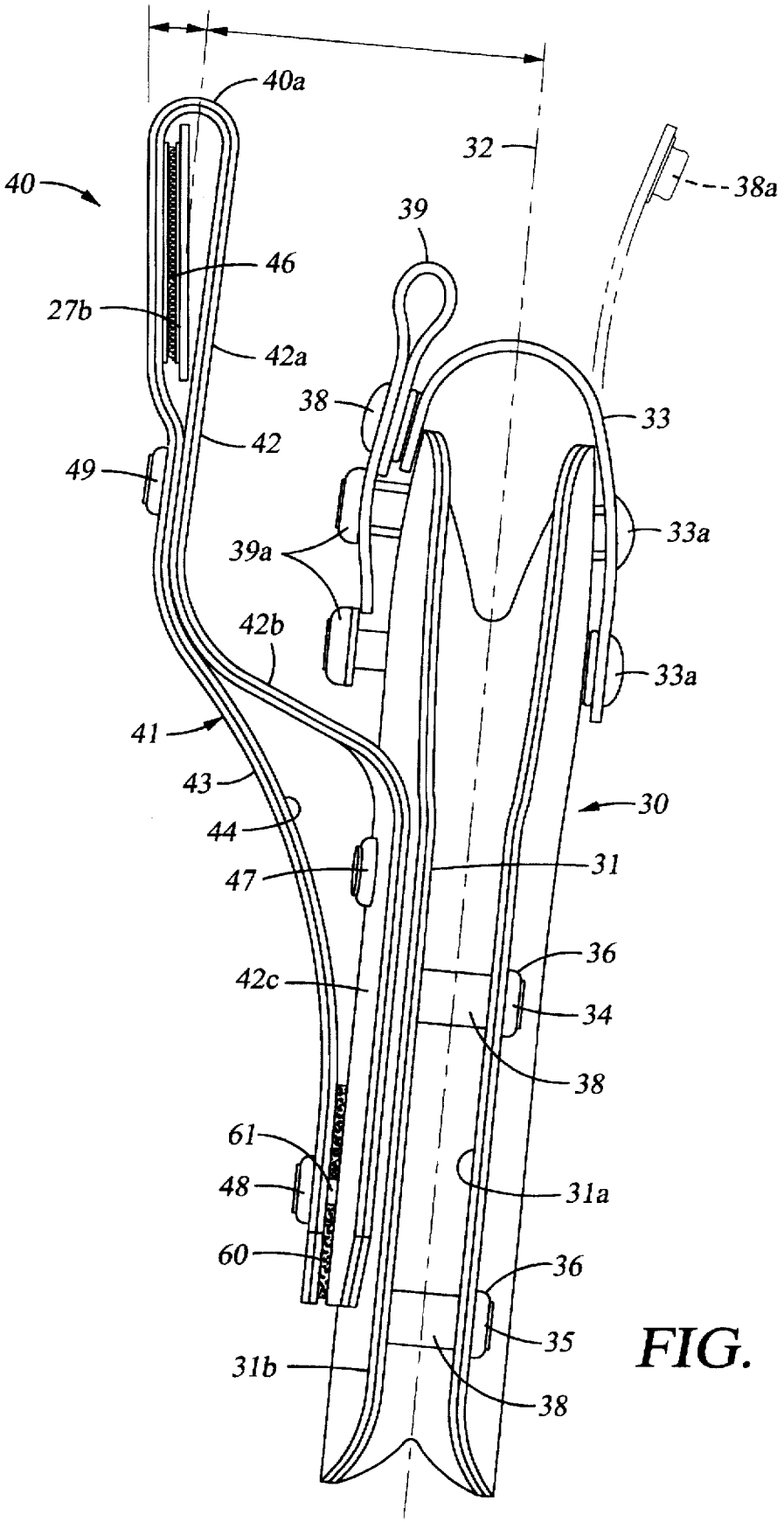
FIG. 7 is an enlarged view of the handgun holster of the harness as views from the rear when worn.
Figure 8:
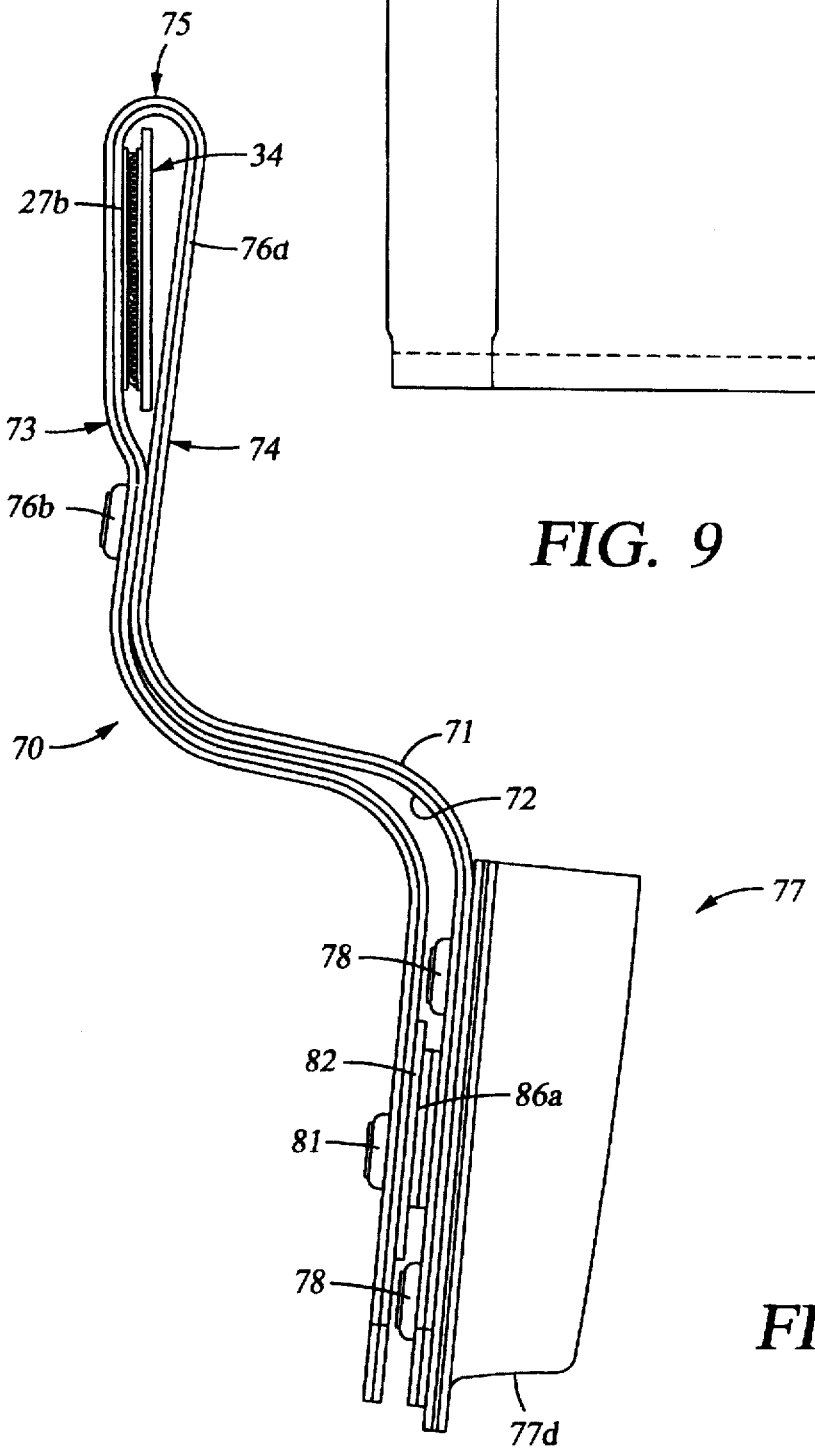
FIG. 8 is an enlarged view showing a pocket for carrying cartridge magazines and its attachment to the waist belt of the harness of FIG. 1.

Suspended on the waist belt 24 is a shankpiece 40 which includes an inner downwardly extending portion 41 and an outer downwardly extending portion 42 on which its handgun holster 30 is mounted. In FIGS. 7, 8 and 10, the shankpiece is shown to be a laminar construction comprising two or more layers 43, 44 of thick leather and between which a thin steel layer 45 shown in FIG. 10 may be inserted for stiffening purposes, particularly in the inner portion 41 which faces against the harness-wearer's body. However, the shankpiece might also be made of other materials such as plastic, or the like. It is also to be noted that the portion 41 may or may not follow the shape of portion 42 as its particular dimensions may be changed as allowed by a particular construction material.

The top curved portion 40*a* of the shankpiece folds over the waist belt 24 and joins the two downwardly extending portions 41,42. The outer portion 42 of the shankpiece comprises a first section 42*a* which extends downwardly from the curved portion 40*a*, a middle section 42*b* which extends outwardly and approximately perpendicularly from the lower end of the section 42*a*, and a third section 42*c* which extends downwardly from the outer end of the middle section 42*b*. As seen in FIG. 1, the shankpiece section 42*c* is approximately in parallel relation to the first section 42*a* and is offset from the thigh of the person wearing the harness 20 when the harness is properly fitted to the wearer's body.

The surface of the shankpiece section 41 which faces the shankpiece section 42 just below the curved portion 40*a* is lined with a patch of VELCRO hook fastener material 46 which engages VELCRO loop fastener material 27*b* fixed to the inside of the waist belt as shown in FIG. 7. By the use of the VELCRO attaching means 46, 27*b*, the shankpiece 40 can be adjustably positioned along the waist belt such that the shankpiece 40 will lie alongside the right thigh.

It will also be seen in FIG. 7 that the holster 30 is secured to the shankpiece section 42C by upper bolts 47 and a pair of lower bolts 48. The inner and outer portions 41,42 of the shankpiece 30 are also clamped against one another by a pair of bolts 49 located just below the waist belt 24. The bolts 49 also secure the VELCRO fastener 46 of the shankpiece 30 onto the VELCRO liner 27*a* of the waist belt but are readily releasable if it becomes desirable to release the shankpiece from the waist belt and to adjust its location along the length of the belt.

As best seen in FIG. 7, the holster 30 is comprised principally from a laminate material 31 and may vary in size and style to accommodate a particular size of firearm and manufacturer's design. The material 31 comprises an outer plastic layer 31*b* of polyurethane or the like and an inner layer 31*a* of suede leather which layers are bonded together by glue and stitching. The laminar material is folded along a center line 32 and its end margins 31, 31*d* secured by a pair of vertically spaced bolts 34,35, each of which extend through a grommet 36 fixed about a bolt opening in the sheet margin section 31*a* of the holster. Each of the bolts 34,35 is also provided with a spacer 38 which is sleeved over the bolt shank between the holster sheet ends 31*a*, 31*b*. The bolts 34,35 are of a selected length as will provide the holster 30 with a particular size to accommodate a particular size of handgun. It is to be appreciated that the holster 30 may be made of different material, such as a single sheet of leather or plastic in lieu of the laminate material 31.

It is also to be seen in FIG. 7, that the holster 30 is provided with a resilient safety strap or retention strap 33 which is bolted at one end to the outside of the holster 30 by bolts 33*a* and provided at its other free end with the stud 38*a* of a snap fastener 38. Although the strap 33 normally assumes a vertical linear configuration, it is adapted to be snap-fastened to the fastener socket 38*b* which is affixed to the end of a second strap 39 secured to the opposite side of the holster by a pair of vertically spaced bolts 39*a*. The safety retention strap 33 is customarily used to retain a handgun 50 when it is inserted in the holster and use of the gun is not imminent. When released, the strap 33 assumes an upright linear configuration as shown in dashed lines in FIG. 7 wherein it is in an out-of-the-way position should the harness wearer desire to quickly withdraw the gun without having to first unsnap the retention strap.

As also in FIGS. 1, 4, and 7, a leg strap 60 is fixed on the outside surface of the holster 30 at the lower end thereof by a bolt 48 which passes through an opening 61 in the strap 60 and clamps the strap 60 between the lower end of the shankpiece section 41 and the end portion 31*b* of the holster sheet material 31. In FIG. 1 it will be seen that the leg strap 60 is provided with a buckle 62 similar to the belt buckle 25. At one end, the strap 60 is provided with a buckle housing 63 which is adapted to receive a buckle latch member 64 fixed near the other end of the strap 60. The length of the strap 60 is adjustable to accommodate a particular leg size by positioning the latch member 64 such that the strap will be tight around the leg when the buckle 62 is fastened.

In FIG. 1 it is also seen that the waist belt 24 is provided with a second shankpiece 70 which is fixed on the belt on the other side of the wearer in substantially diametrically opposed relation to the shankpiece 40 when the belt 24 encircles the waist of the harness-wearer. The shankpiece 70, as seen in FIG. 8 is of similar construction to the shankpiece 40, preferably of leather laminar sections 71,72 but which also could be made of plastic or the like. Like the shankpiece 40, shankpiece 70 comprises two downwardly extending portions 73,74 joined at its top by a curved portion 75. The inside surface of the portion 72, just below the curve 75, is provided with a patch of VELCRO hook fastener material 76*a* which is adapted to engage the VELCRO loop fastener material 27*b* which lines the inside of the waist belt. The two portions 73, 74 of the shankpiece 70 are clamped to one another by a pair of bolts 76*b* just below the waist belt 24, which bolts are readily releasable if it becomes desirable to release the VELCRO attachment of the shankpiece 70 and to re-position it along the waist belt to accommodate a particular sized person when wearing the harness.

Figure 2:
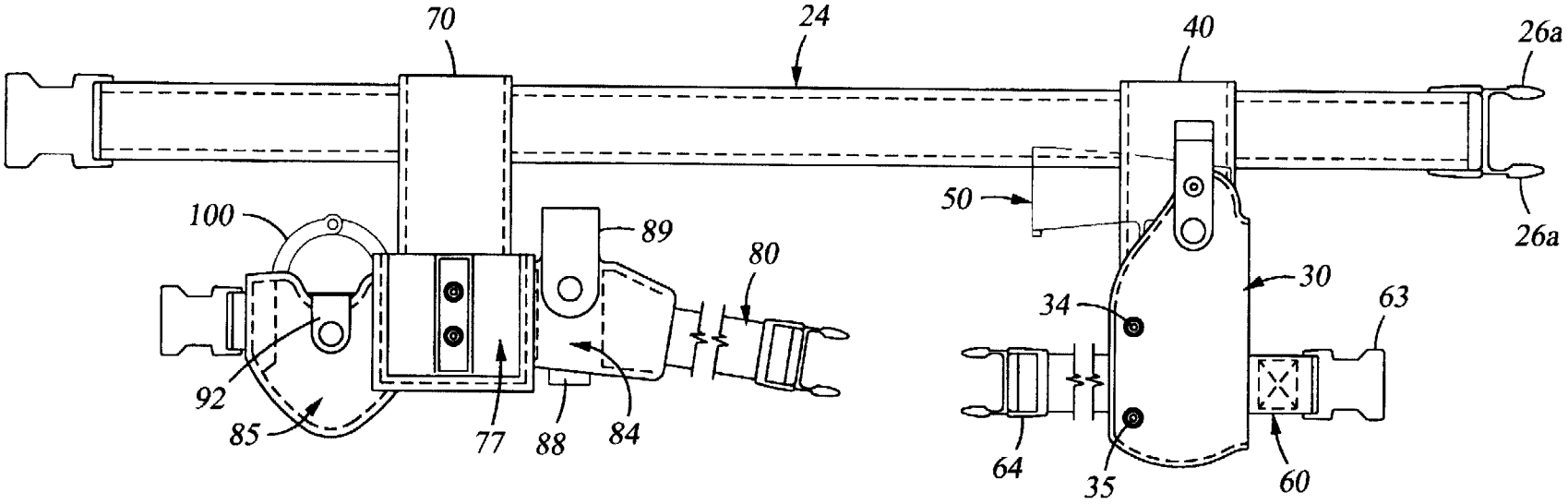
FIG. 2 is a plan view of the harness of FIG. 1 with the waist belt component of the harness extended to its full length.
Figure 9:
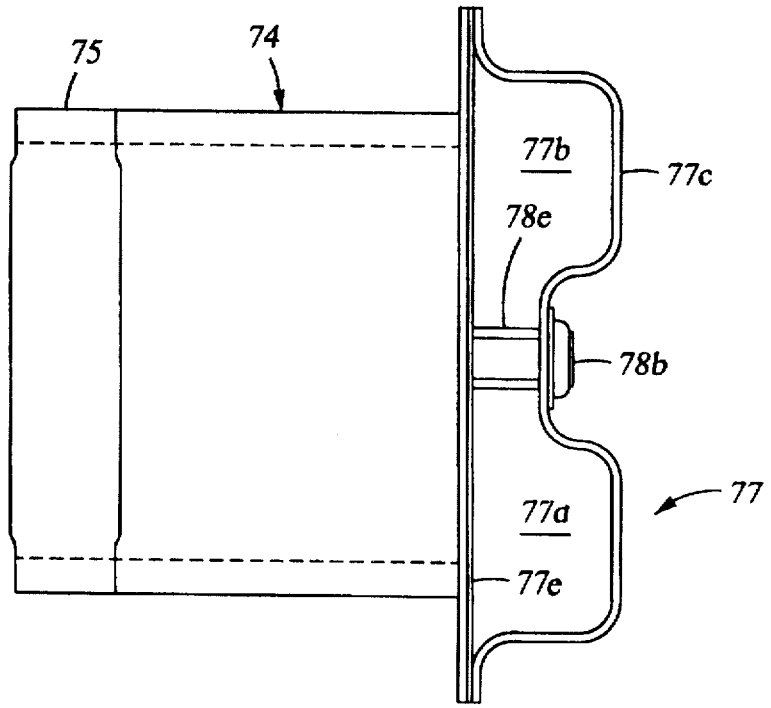
FIG. 9 is a top view of the open end of the pocket shown in FIG. 8.

In FIGS. 8 and 9 there is shown a pocket 77, formed of stiff leather or plastic material which is fastened to the outside of the shankpiece portion 74 by means of vertically spaced bolts 78 which clamp the pocket 77 to the shankpiece. Two additional bolts 78*b* hold the outer wall 77*c* of the pocket 77 to its inner wall 77*e* and basically divide the pocket in two compartments 77*a*, 77*b*, each of which is sized for a desired level of retention, to snugly accommodate a cartridge magazine 79 as seen in FIGS. 1 and 2. The shank of each bolt 78*b* is provided with a spacer sleeve 78*e* which is sleeved about the bolt shank and spaces the outer wall 77*c* of the pocket 77 from the shankpiece portion 74 and thereby determines the size of the pocket. The pocket 77 is formed with a bottom 77*d* and is open at the top.

It will also be seen in FIGS. 2 and 8, that a second flexible fabric leg strap 80 is clamped near one end between the downwardly extending portions 73, 74 of shankpiece 70 by a pair of horizontally spaced bolts 81 which pass through accommodating holes 82 formed in the leg strap 80. The leg strap 80 is essentially identical to the leg strap 60, being provided with a buckle fastener 83, identical to the buckle 62, and being adjustable in length to accommodate the leg of the harness wearer.

Figure 6:
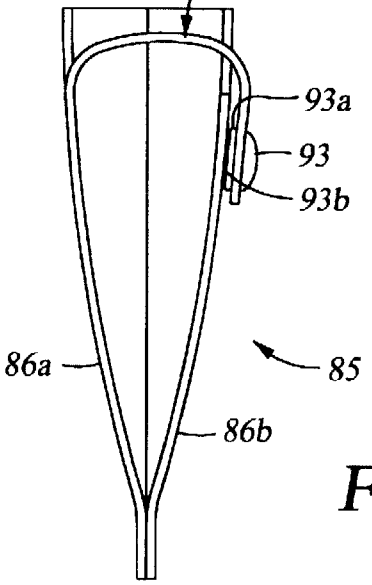
FIG. 6 is an enlarged edge view of a pouch for handcuffs which is mounted on the waist belt at a location which is at the person's side opposite the handgun holster when the harness is worn.
Figure 5:
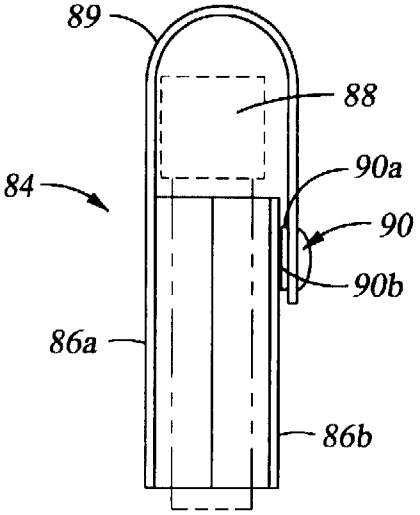
FIG. 5 is an enlarged edge view of a flashlight container which is mounted on the waist belt of the harness so as to be carried on the side opposite the handgun holster when the harness is worn.

In FIG. 2 it is also to be seen that in addition to the magazine pocket 77, a sleeve-like flash light container 84 and a handcuff pouch 85, both of which are optional, may be mounted on the shankpiece 70 in straddle relation to the pocket 77. As shown in FIGS. 5 and 6 the container 84 and pouch 85 are formed from two sheets of stiff leather or pliant plastic 86*a*, 86*b* which are joined together along their central sections and clamped between the two downwardly extending portions 72, 74 of the shankpiece 70 by the bolts 81. It will also be seen in FIG. 8 that the sheet 86*a* is also clamped against the leg strap 80.

To form the flash light container 84 and the pouch 85, the two leather sheets 86*a*, 86*b* are threaded together along each pair of their adjacent extremities but are separated and spaced from one another to form an open area between each extreme end of the sheets and their central bonded sections. In FIG. 5, such an open area or spacing forms the sleeve-like container 84 which is sized to accommodate and support a flashlight 88 therein. The inner sheet 86*a* is also formed with a narrow upward extension which forms a flexible strap 89. The strap 89 is fitted at its end with the stud 90*a* of a snap fastener 90 which is operatively engageable with the socket member 90*b* affixed to the outside of the flash light container 84 and the sheet 86*b*.

The pouch 85 is formed by a second open spacing of the sheets 86*a*, 86*b* adjacent to their other joined ends as shown in FIG. 6. The two sheets 86*a*, 86*b* are joined by threading along their bottom edges to form the bottom of pouch 85. The pouch 85 is particularly adapted to accommodate a set of handcuffs 100 therein as shown in FIGS. 1 and 2 and similar to the flashlight container 84 is provided with a retainer strap 92 formed from a narrow upwards extension of the sheet 86*a*. The retainer strap 92 is also fitted with a snap fastener 93 having a stud member 93*a* which is adapted to cooperatively engage with the socket 93*b* affixed to the leather sheet 86*b*.

It will also be seen in FIG. 4, that near their joined extremities, the two sheets 86*a*, 86*b* which form the container 84 and pouch 85 are provided with elongated slot openings 94*a*, 94*b* for accommodating the leg strap 80 which is inserted therethrough. Accordingly, when the leg strap 80 is tightened about the left leg of the wearer as seen in FIG. 1, the container 84 and handcuff pouch 85 are secured tightly against the body of the harness wearer.

It is to be understood that the shankpiece 70 and the leg strap 80 which is fixed thereto, serve, as their principal purpose, particularly when accessory equipment is carried, to maintain the waist belt in a fixed position about the waist of the harness wearer and prevent any up or down shifting or rotation of the waist belt in either direction about the wearer's waist. The shankpiece 70 and leg strap 80 are important factors in enabling the harness to support the gun holster 30 in a very stable position relative to the adjacent hip and torso of the harness wearer. Since the two leg straps 60 and 80 are secured near the crotch, none of the movement of the harness wearer's legs, as when walking, climbing, rappelling or running, is communicated to the shankpieces 40 and 70. The handgun holster 30 therefore remains in the same position relative to the torso regardless of the activity of the harness wearer. Accordingly, the harness 20 insures that the handle of a handgun inserted in the holster 30 will always be in the same position relative to the wearer's hip and torso. If a "quick-draw" or re-holster necessity arises, the harness wearer will have greatly improved capability of grasping the gun handle correctly in a shorter time than is likely with conventional holster harnesses wherein the gun and gun handle move and shift with the wearer's leg motion. It will also allow the harness-wearer to re-holster the weapon without having to look or hunt for the holster opening. Also, because the holster 30 is retained in a more stable position, there is less chance of the handgun falling from the holster.

It is also to be appreciated that the accessory equipment pockets and containers which are provided for the harness by mounting on the second shankpiece 70 are entirely optional and may be varied in design as necessary to accommodate different kinds of accessory equipment.

It is therefore to be understood that the foregoing description of a preferred embodiment of the invention has been presented for purposes of illustration and explanation and is not intended to limit the invention to the precise form disclosed. For example, different materials may be used in the composition of the various pieces of the harness than are herein disclosed and different buckles may be provided for the waist belt and leg straps. The accessory pouches are also optional and their particular design is arbitrary. It is to be appreciated therefore that various material and structural changes may be made by those skilled in the art without departing from the invention.

I claim:

1. A harness for mounting handgun holster at the thigh of a wearer's body in close proximity thereto and for maintaining the relative position and orientation of the holster with respect to the wearer's torso, said harness comprising:

a belt for wearing about the wearer's waist;

a primary shankpiece attached to the waist belt at a location to position said primary shankpiece at the wearer's thigh when the belt is worn, said primary shankpiece comprising an outer portion having a substantially rigid offset section extending outwardly from the belt and a lower vertical section extending downwardly from the outer end of aid offset section in relation to the wearer's thigh;

a handgun holster fixedly attached to said lower vertical section of said primary shankpiece in offset spaced relation to the wearer's thigh and in an orientation such that the barrel of a gun when inserted in the holster is pointed downwardly, said primary shankpiece having an inner portion connected to said outer portion and extending from the waist belt downwardly between the wearer's thigh and the lower vertical section of said outer portion;

a first adjustable leg strap fixedly attached to said downwardly extending inner portion of the primary shankpiece and adapted to be tightened around the wearer's leg at the crotch of the wearer;

a secondary shankpiece fixedly attached to the waist belt at a location which positions said secondary shankpiece at the other side of the wearer when the waist belt is worn, said secondary shankpiece comprising an outer portion with an offset section extending outwardly from the waist belt and a lower vertical section extending downwardly from the outer end of its offset section, said secondary shankpiece having an inner portion extending downwardly from the waist belt between said lower vertical section of said outer portion of the secondary shankpiece and the wearer's other thigh; and a second adjustable leg strap fixedly attached to the inner portion of said secondary shankpiece and adapted to be tightened around the other leg of the wearer adjacent to the wearer's groin.

2. A harness as set forth in claim 1 further including pocket means fixed to the other surface of the lower vertical section of said outer portion of said secondary shankpiece and adapted to receive cartridge magazines for a handgun.

3. A harness as set forth in claim 1 further including a pouch means attached to said secondary shankpiece, said pouch means being adapted to receive a set of handcuffs therein.

4. A harness as set forth in claim 1 further including a container means attached to said secondary shankpiece, said container means being adapted to receive a flashlight therein.

5. A harness as set forth in claim 1 wherein said primary and secondary shankpieces are attached to the waist belt by a first pliant fastener means affixed to said waist belt and which is adapted to cooperatively engage and fasten to second and third pliant fastener attaching means affixed to said shankpieces.

6. A harness as set forth in claim 3 wherein said pouch means is provided with a retainer strap means including a strap fastener which is selectively operable for containment of a set of handcuffs deposed in the pouch means.

7. A harness as set forth in claim 4 wherein said container means is provided with a retainer strap means including a strap fastener which is selectively operable for containment of a flashlight deposited in the container means.

8. A harness for mounting a handgun holster at the thigh of a wearer's body in close proximity thereto and for maintaining the relative position and orientation of the holster with respect to the wearer's torso in spite of leg motion activities of the harness wearer, said harness comprising:

a belt for wearing about the wearer's waist;

a first shankpiece attached to the waist belt at a location to position said first shankpiece at the wearer's thigh when the belt is worn, said first shankpiece comprising an outer component having an offset section extending outwardly from the belt and a lower vertical section extending downwardly from the outer end of said offset section in relation to the wearer's thigh;

a handgun holster fixedly attached to said lower vertical section of the outer component of said first shankpiece in offset spaced relation to the wearer's thigh and in an orientation such that the barrel of a gun when inserted in the holster is pointed downwardly, said first shankpiece having a portion folded over the waist belt and an inner component extending downwardly between the wearer's thigh and the lower vertical section of said outer component;

a first adjustable leg strap fixedly attached to said downwardly extending inner component of the first shankpiece and adapted to be tightened around the wearer's leg at the groin of the wearer;

a second shankpiece fixedly attached to the waist belt at a location which positions said second shankpiece at the other side of the wearer when the waist belt is worn, said second shankpiece comprising an outer component with an offset section extending outwardly from the waist belt and a lower vertical section extending downwardly from the outer end of its offset section, said second shankpiece being folded over the waist belt and having an inner component extending downwardly from the waist belt between said lower vertical section of the second shankpiece and the wearer's other thigh; and a second adjustable leg strap fixedly attached to the inner component of said second shankpiece and adapted to be tightened around the other leg of the wearer, adjacent to the groin.

9. A harness as set forth in claim 8 further including:

pocket means fixed to the outer surface of the lower vertical portion of said outer portion of said second shankpiece and adapted to receive cartridge magazines for a handgun;

pouch means attached to said second shankpiece, said pouch means being adapted to receive a set of handcuffs therein; and container means attached to said second shankpiece, said container means being adapted to receive a flashlight therein.

10. A harness for mounting a handgun holster at the thigh of a wearer's body in close proximity thereto and for maintaining the relative position and orientation of the holster with respect to the wearer's torso in spite of leg motion activities of the harness wearer, said harness comprising:

a belt for wearing about the wearer's waist;

a shankpiece attached to the waist belt at a location to position said shankpiece at the wearer's thigh when the belt is worn, said shankpiece comprising an outer component having a substantially rigid offset section extending outwardly from the belt and a lower vertical section extending downwardly from the outer end of said offset section in relation to the wearer's thigh;

a handgun holster fixedly attached to said lower vertical section of said shankpiece in offset spaced relation to the wearer's thigh and in an orientation such that the barrel of a gun when inserted in the holster is pointed downwardly, said shankpiece having a portion folded over the waist belt and an inner component extending downwardly between the wearer's thigh and the lower vertical section of said outer component; and an adjustable leg strap fixedly attached to said downwardly extending inner component of the shankpiece and adapted to be tightened around the wearer's leg at the top of the thigh and at the groin of the wearer, said harness thereby serving to consistently maintain the position of the holster relative to the wearer's torso despite a change in body position and leg motion activities of the harness wearer.

* * * * *